US008282513B2

(12) United States Patent
Rosenkranz et al.

(10) Patent No.: US 8,282,513 B2
(45) **Date of Patent: *Oct. 9, 2012**

(54) RACKET COMPRISING A JOINT

(75) Inventors: Harald Rosenkranz, Lauterach (AT); Johan Kotze, Wolfurt (AT); Stefan Mohr, Wolfurt (AT); Ralf Schwenger, Weiler im Allgäu (DE)

(73) Assignee: Head Technology GmbH, Kennelbach (AT)

( * ) Notice: Subject to any disclaimer, the term of this patent is extended or adjusted under 35 U.S.C. 154(b) by 0 days.

This patent is subject to a terminal disclaimer.

(21) Appl. No.: 12/744,658

(22) PCT Filed: Nov. 10, 2008

(86) PCT No.: PCT/EP2008/009470

§ 371 (c)(1),
(2), (4) Date: Sep. 3, 2010

(87) PCT Pub. No.: WO2009/068178

PCT Pub. Date: Jun. 4, 2009

(65) Prior Publication Data

US 2011/0003654 A1 Jan. 6, 2011

(30) Foreign Application Priority Data

Nov. 26, 2007 (DE) ..... 10 2007 056 831

(51) Int. Cl.
*A63B 49/02* (2006.01)

(52) U.S. Cl. ..... 473/546; 473/521

(58) Field of Classification Search ..... 473/520, 473/521, 524, 546

See application file for complete search history.

(56) References Cited

U.S. PATENT DOCUMENTS

| | | | | | |
|---|---|---|---|---|---|
| 1,937,787 | A | | 12/1933 | Robinson | |
| 4,209,170 | A | | 6/1980 | Garver | |
| 4,247,103 | A | | 1/1981 | Garver | |
| 4,311,308 | A | | 1/1982 | Völkl et al. | |
| 4,550,909 | A | * | 11/1985 | Sommer | 473/546 |
| 4,828,260 | A | * | 5/1989 | Todd | 473/521 |
| 4,889,338 | A | * | 12/1989 | Keijiro | 473/546 |
| 5,076,583 | A | * | 12/1991 | Hsu | 473/537 |
| 5,133,552 | A | | 7/1992 | Feeney et al. | |
| 5,172,911 | A | * | 12/1992 | Chang | 473/521 |
| 5,178,388 | A | | 1/1993 | Schlenker | |
| 5,282,617 | A | | 2/1994 | Hong | |
| 5,324,030 | A | * | 6/1994 | Tsou | 473/521 |

(Continued)

FOREIGN PATENT DOCUMENTS

DE 36 09 453 A1 10/1987

(Continued)

OTHER PUBLICATIONS

International Search Report and Written Opinion for PCT/EP2008/009470, dated Apr. 3, 2009.

(Continued)

*Primary Examiner* — Raleigh W. Chiu
(74) *Attorney, Agent, or Firm* — Finnegan, Henderson, Farabow, Garett & Dunner LLP

(57) ABSTRACT

The invention relates to a racket for ball games, in particular a tennis or squash racket, comprising a head region for receiving a stringing as well as at least one joint which is provided in the head region and the joint axis of which is arranged essentially perpendicularly with respect to a stringing plane formed by the stringing.

20 Claims, 6 Drawing Sheets

U.S. PATENT DOCUMENTS

| | | | | |
|---|---|---|---|---|
| 5,350,173 | A * | 9/1994 | DiCerbo | 473/521 |
| 5,599,018 | A * | 2/1997 | Radel | 473/521 |
| 5,779,572 | A | 7/1998 | Dicerbo | |
| 7,229,369 | B2 * | 6/2007 | Schwenger | 473/546 |
| 8,007,380 | B2 * | 8/2011 | Rosenkranz et al. | 473/546 |
| 2005/0277496 | A1 * | 12/2005 | Schwenger | 473/546 |
| 2009/0163306 | A1 * | 6/2009 | Rosenkranz et al. | 473/546 |

FOREIGN PATENT DOCUMENTS

| | | | |
|---|---|---|---|
| DE | 43 11 175 | A1 | 10/1993 |
| DE | 10 2006 004 849 | A1 | 8/2007 |
| EP | 0 455 885 | A1 | 11/1991 |
| EP | 0 676 222 | B1 | 6/2000 |
| EP | 1 097 730 | B1 | 10/2004 |
| FR | 2 845 610 | | 4/2004 |
| JP | 53063138 | A * | 6/1978 |
| WO | WO 90/11804 | | 10/1990 |
| WO | WO 91/12857 | | 9/1991 |

OTHER PUBLICATIONS

Notification of the First Office Action dated Jan. 4, 2012, in corresponding China Application No. 200820117924.2 (6 pages).

Office Action mailed Nov. 15, 2010, in U.S. Appl. No. 12/292,751 (6 pages).

Reply to Office Action filed Mar. 15, 2011, in U.S. Appl. No. 12/292,751 (8 pages).

Notice of Allowance mailed Apr. 8, 2011, in U.S. Appl. No. 12/292,751 (1 page).

* cited by examiner

RACKET COMPRISING A JOINT

The present invention relates to a racket for ball games, in particular a tennis racket, badminton racket, racquet ball racket or squash racket.

Ball game rackets of this kind typically have a frame forming a racket head or head region as well as a handle region. Moreover, ball game rackets of this kind can comprise a throat or heart region or a fork arranged between the head region and the handle region. The racket head of the racket defines a stringing plane in which the stringing of the racket is arranged. For receiving the strings of the stringing, through holes through which strings can be passed are provided at the frame in the stringing plane. Normally, the frame is formed of a frame profile which is often fabricated from a carbon fiber reinforced plastic material in a molding press.

Moreover, it is known to provide different cross-sectional shapes of the frame profile at different portions of the frame, for example for being able to influence deformation of the racket.

For example, EP-B-0 676 222 discloses a racket comprising a handle and a frame having a head portion, power reinforcing portions and flexible portions formed along the entire frame or along a part of the frame remote from the handle in an alternating manner, wherein 10 to 20 power reinforcing portions and 10 to 20 flexible portions are provided.

WO-A-91/12857 relates to a racket comprising a frame which is formed by a profile and to the outer side of which a profile component arranged at a distance from the frame is assigned, the profile component being supported on the frame with the insertion of a vibration damping device and bearing the strings of a stringing.

EP-B-1 097 730 relates to a ball game racket, wherein a profile forming the frame has different cross-sectional shapes on different frame positions according to the kinds of main stress occurring there, said cross-sectional shapes having moments of resistance being adapted to the respective kinds of stress, and wherein at least two bulge-like stiffening elements are provided at the frame in the throat region essentially symmetrically with respect to the longitudinal axis of the racket.

Moreover, it is known to arrange damping devices at different positions of the frame, for example for providing improved damping characteristics. A racket of this kind is described, e.g., in DE 10 2006 004 849 A1.

U.S. Pat. No. 4,311,308 describes a tennis racket comprising an insert in the throat region, which insert is adapted to have secured thereto at least some strings. This insert can be formed as a joint having a joint axis in the stringing plane and realized essentially parallel to the longitudinal axis of the racket. In response to the impact of an arriving ball, the insert may undergo elastic deformation, i.e. in a direction perpendicular with respect to the stringing plane.

U.S. Pat. No. 5,133,552 discloses a tennis racket whose frame comprises curved recesses in the throat region. A yoke (or bridge) has curved ends which essentially conform to the curvature of these recesses. An elastomeric cushion is positioned between the yoke ends and the recesses of the frame. Said elastomeric cushion helps to reduce shocks and vibrations in the racket.

However, some of the rackets known in the prior art do not guarantee the optimum ball control, the optimum stiffness and/or the optimum damping behavior of a racket, so that accuracy, impulse absorption and handling and/or playing behavior of these known rackets still need to be improved. The rackets known in the prior art moreover do not exhibit an optimum acceleration behavior that can be transmitted from the racket to the ball. In particular, in known rackets it is hardly possible to control the deformation of the racket frame caused by the impact of the ball on the racket and the related impulse absorption in a well-aimed manner and/or to transform the impulse effectively into striking force.

It is an object of the present invention to provide a further improved ball game racket, in particular an improved tennis, badminton, racquet ball and squash racket. Further or additional objects of the invention are to provide a racket which overcomes the disadvantages of the prior art, can be handled in an improved manner and/or exhibits optimized playing characteristics, allows an excellent ball control and acceleration and can be produced in a simple and cost-efficient manner.

This object is achieved by the features of the independent claims. Preferred embodiments of the invention are described in the dependent claims.

Accordingly, the present invention provides a racket for ball games comprising a head region for receiving a stringing as well as at least one joint which is provided in the head region and the joint axis of which is arranged essentially perpendicularly with respect to a stringing plane formed by the stringing.

According to a further aspect, there is provided a racket for ball games which comprises a head region for receiving a stringing as well as at least one joint provided in the head region, wherein the joint is adapted to allow deformations of the frame in the stringing plane. This can be realized, in particular, by a joint the joint axis of which is arranged essentially perpendicularly with respect to a stringing plane formed by the stringing.

The shape of the racket head is to a large extent arbitrary and can be, e.g., oval, egg-shaped, drop-shaped, rectangular with rounded corners, etc. For defining the position of the joint or joints along the circumference of the racket head, normally a clock face is used, with the twelve o'clock position being arranged at the outermost, i.e. free end of the racket head. The three o'clock position and the nine o'clock position accordingly lie approximately in the center of the overall length of the racket head. For example, the joint(s) can be arranged in the head region between two o'clock and four o'clock, preferably at approximately three o'clock, and/or between eight o'clock and ten o'clock, preferably at approximately nine o'clock. An arrangement of the joint "at approximately three o'clock" is to be understood such that the point of rotation or axis of rotation is positioned at approximately three o'clock.

Alternatively or additionally, the joint and/or a further joint can be arranged in the head region between eleven o'clock and one o'clock, preferably at approximately twelve o'clock. However, also other joint positions or combinations of joint positions are conceivable. Typically, an arrangement symmetrically with respect to the longitudinal axis of the racket will be advantageous; however, an asymmetric arrangement, with for example only one joint at approximately three o'clock, should not be excluded here.

According to a preferred embodiment, the racket comprises a throat region with two arms and a bridge, wherein the bridge comprises at least one joint. This bridge joint can be provided instead of the above joints or also in addition thereto. Such a bridge joint can be realized, e.g., in that the bridge comprises two legs which are mounted in a movable manner at the arms and connected with each other by means of the joint.

According to a variant of the embodiment, the bridge is convex relative to the handle portion, in particular essentially V-shaped or U-shaped, with the opening of the V or U being directed towards the head region. In accordance with a second variant of this embodiment, the bridge is concave relative to the handle portion, in particular essentially V-shaped or U-shaped, with the point of the V or U being directed towards the head region.

Different types of joints can be used for the above-mentioned embodiments. For instance, the joint can be realized as hinge joint or ball joint. A ball joint is advantageous, in particular, at approximately twelve o'clock and/or at the bridge. The head region can possibly also comprise joint forks and/or eyes which are connected with each other in a movable manner by means of insertable joint bolts. In general, all known kinds of industrial joints can be used. Materials to be used for this purpose are, e.g., aluminum, magnesium, titanium or high performance plastics such as polyoxymethylene or polytetrafluoroethylene.

Moreover, it is advantageous if the joint comprises at least one end stop for limiting and/or slowing down the articulation of the joint in order to be able to thus control the deformation of the racket head in a well-aimed manner. Thus, it is desirable that the joint allows pivoting angles ranging between −15 to 15 degrees, preferably −10 to 10 degrees, particularly preferably −5 to 5 degrees. Moreover, for this purpose the joint can comprise a spring means counteracting the articulation of the joint.

In the following, a racket according to the invention is described on the basis of a plurality of preferred embodiments and with reference to the drawings in which FIG. 1 shows a top view of a ball game racket according to a preferred embodiment of the invention;

FIG. 1*a* shows a schematic side view of a first joint type in the racket according to FIG. 1;

FIG. 1*b* shows a schematic side view of a second joint type in the racket according to FIG. 1;

Figures 1, 1A, 1B:
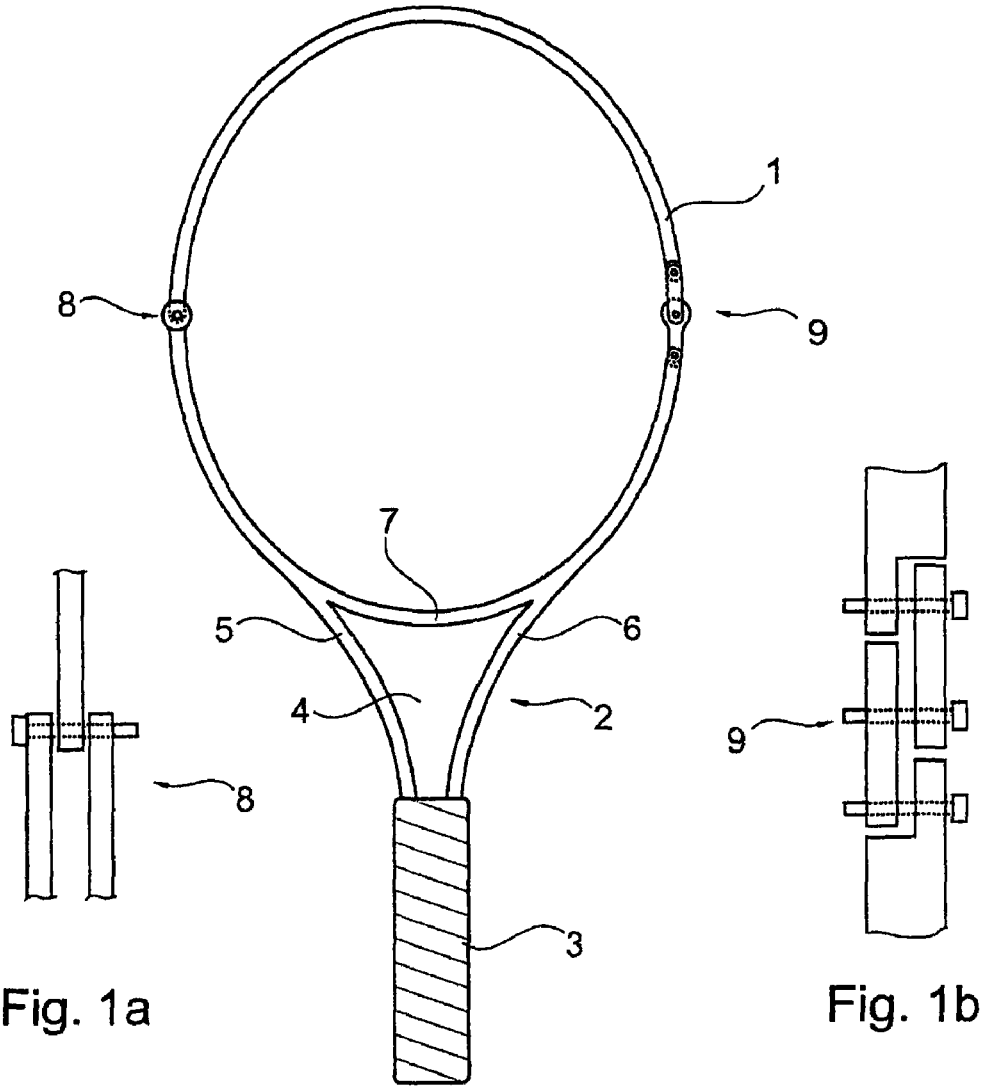

FIG. 1 shows a top view of a ball game racket according to the invention, in particular a tennis racket. The ball game racket comprises a frame forming an essentially oval racket head or head region 1, a throat region 2 and a handle portion 3. The frame is preferably made of a frame profile or hollow profile. The racket head defines a stringing plane of the racket. For receiving the stringing (not shown), the frame comprises in the region of the head region 2 a plurality of through holes (not shown) which lie essentially in the stringing plane and through which strings of the stringing can be passed. The throat region 2 of the racket is arranged essentially between head region 1 and handle portion 3 and represents the connection region between them. The throat region 2 comprises, e.g., one opening 4, as shown in FIG. 1. However, this opening is not urgently necessary. If, however, the opening 4 is present, it is generally formed by two side portions or arms 5 and 6 as well as a connection portion or bridge 7 arranged in the head region 2 of the racket.

According to the preferred embodiment shown in FIG. 1, the racket moreover comprises two joints 8 and 9 in the head region 2 at approximately three o'clock and nine o'clock, respectively. The different designs of the joints 8 and 9 here only serve the purpose of illustrating exemplary joints. In reality, it will be advantageous to arrange two equal joints at both positions. For example, the joint 8 can be formed in that the head region comprises joint forks and/or eyes which are connected with each other in a movable manner by means of insertable bolts, as indicated on the left-hand side of FIG. 1 and shown in more detail in FIG. 1*a*. For achieving a greater movability, however, for example also a double joint arrangement 9 can be used, as schematically shown in FIG. 1*b*.

Figure 2:
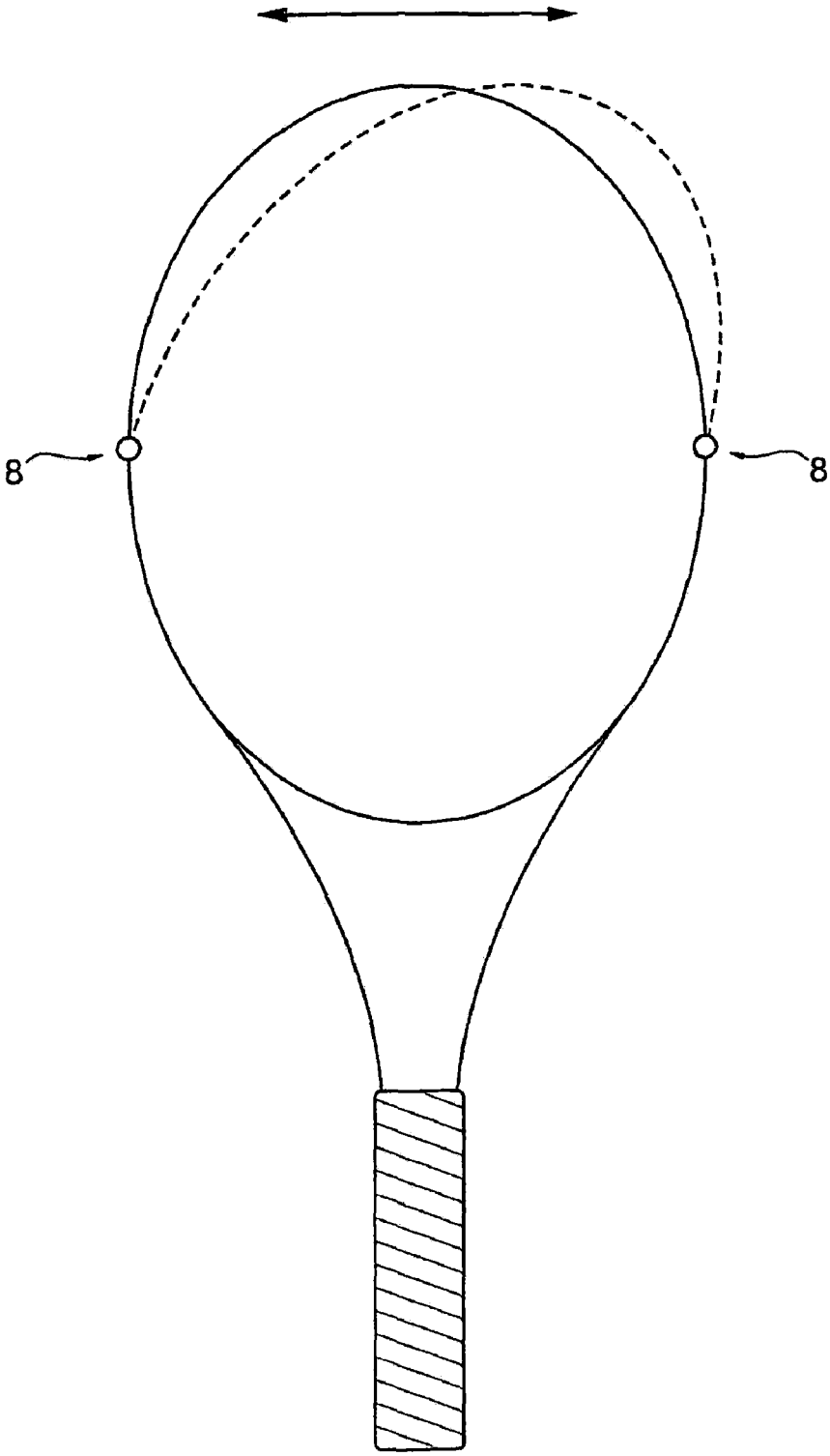
FIG. 2 shows a schematic diagram of possible deformations of the head region of a racket according to FIG. 1.

FIG. 2 schematically shows how the joints 8 allow a deformation of the head region 1 of the racket shown in FIG. 1. Under the influence of respective forces, the upper half of the head region 1, i.e. the region between approximately nine o'clock and approximately three o'clock, can be shifted or distorted relative to the remaining frame, as indicated by the arrow and the dashed frame contour. Since the joint axes of the joints 8 are formed perpendicularly with respect to the stringing plane, however, a deformation is essentially possible only within the stringing plane or racket plane. The typical deformations of the frame in conventional rackets—also deformations perpendicular with respect to the stringing plane—are of course not limited by the joints of the invention. Only the deformations that occur additionally because of the joints are limited essentially to the stringing plane.

For illustrating the situation, the occurring deformation is exaggerated to a great extent. As already discussed, it is advantageous if the joint 8 comprises at least one end stop for limiting and/or slowing down the articulation of the joint in order to be able to thus control deformation of the racket head in a well-aimed manner and in particular avoid that the racket and/or its stringing collapse(s). Thus, it is desirable that the joint allows articulations relative to the position shown in a full line in FIG. 2 in a range of −15 to 15 degrees, preferably −10 to 10 degrees, particularly preferably −5 to 5 degrees. Moreover, for this purpose the joint can alternatively or additionally comprise a spring means counteracting the articulation of the joint. The spring constant of this spring means ranges between 5 and 100 N/cm, preferably between 30 and 70 N/cm. In particular, also non-linear springs or spring means might be used advantageously in this connection.

Moreover, it is possible for the spring means to have two different operating ranges so that, e.g., articulations of the joint 8 in the inward direction, i.e. in the direction of the stringing, are exposed to a greater spring force than articulations in the outward direction. The stops for limiting articulations can likewise allow different articulation angles in the inward and outward directions.

For controlling or adapting the deformation spectrum, the joints 8 can be attached in different manners to the head region 1. For example, a larger portion of the head region 1 will take part in the deformation if the joints 8 are positioned closer to the handle, i.e. for example at approximately four o'clock and approximately eight o'clock. Accordingly, when the joints are positioned at approximately two o'clock and approximately ten o'clock, less than half of the head region is distorted.

Figure 3:
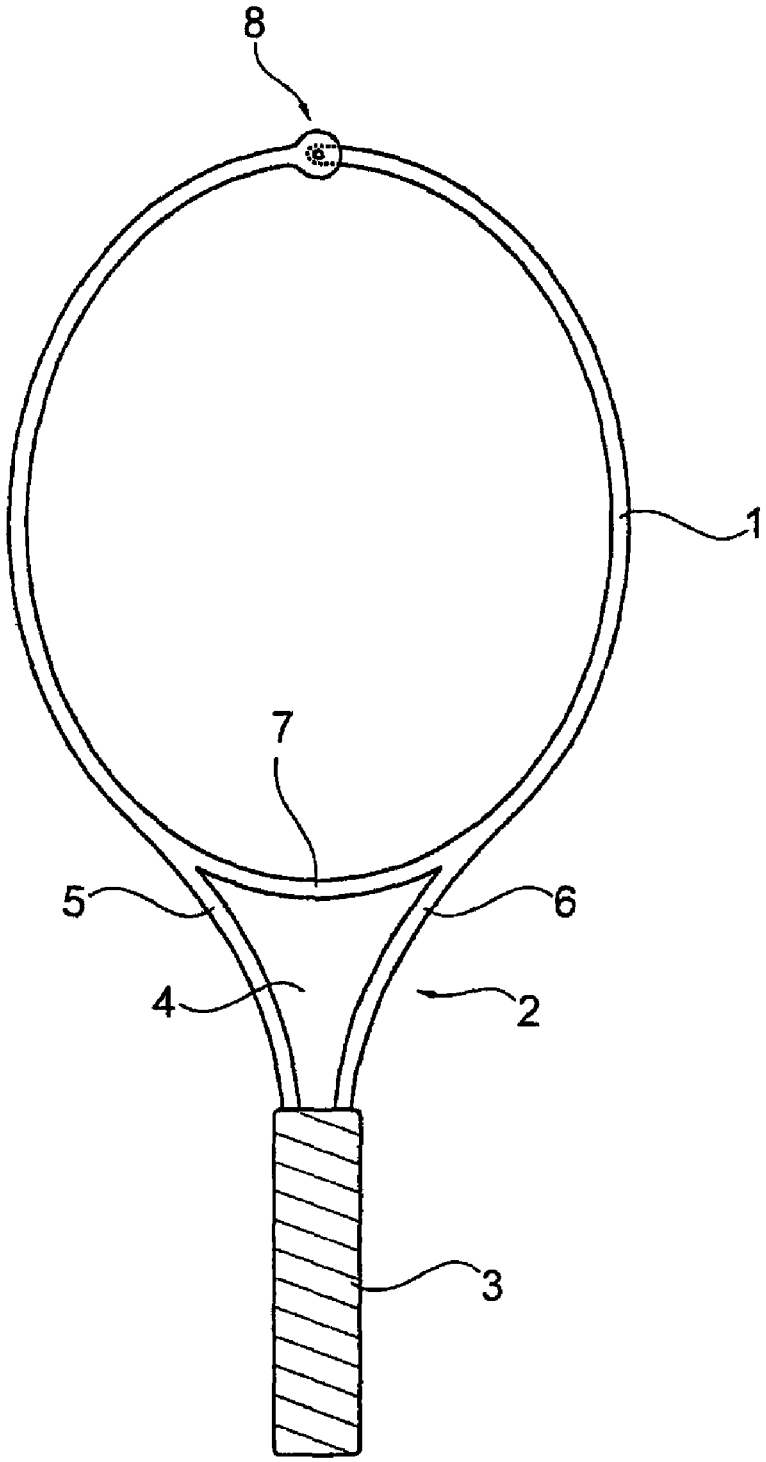
FIG. 3 shows a top view of a ball game racket according to a further preferred embodiment of the invention.

FIG. 3 shows a further ball game racket according to the invention which has a joint 8 at approximately twelve o'clock. This embodiment can also be realized by means of joint 9. Moreover, a racket according to the invention can also be provided by a combination of the joints and/or joint positions shown in FIGS. 1 and 3, i.e. comprise joints at approximately three, nine and twelve o'clock.

Figure 4:
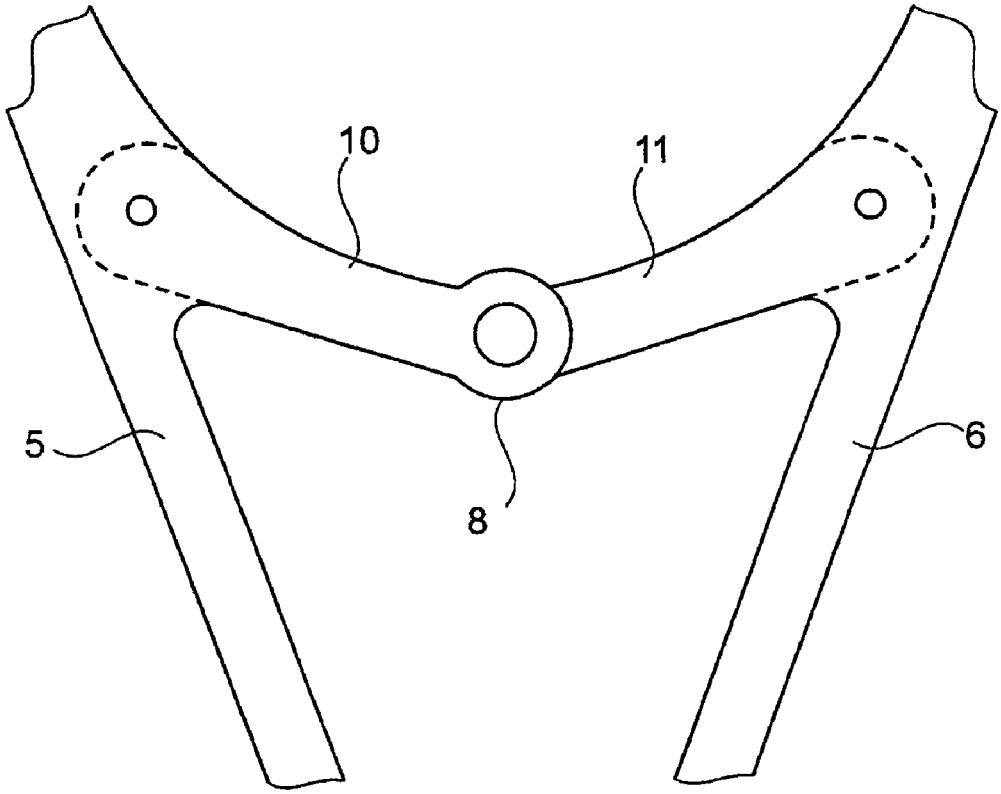
FIG. 4 shows a top view of the throat region of a ball game racket according to a further preferred embodiment of the invention.

FIG. 4 shows the throat region of a further embodiment of a ball game racket according to the invention. In said racket, the bridge comprises two legs 10 and 11 which are mounted in a movable manner at the arms 5 and 6 and connected with each other by means of a joint 8. Here, too, the shown joint is only an example and can also be realized in a different technical manner. In the shown variant of this embodiment, the bridge is convex relative to the handle portion, namely U-shaped, with the opening of the U being directed towards the head region.

Figure 5:
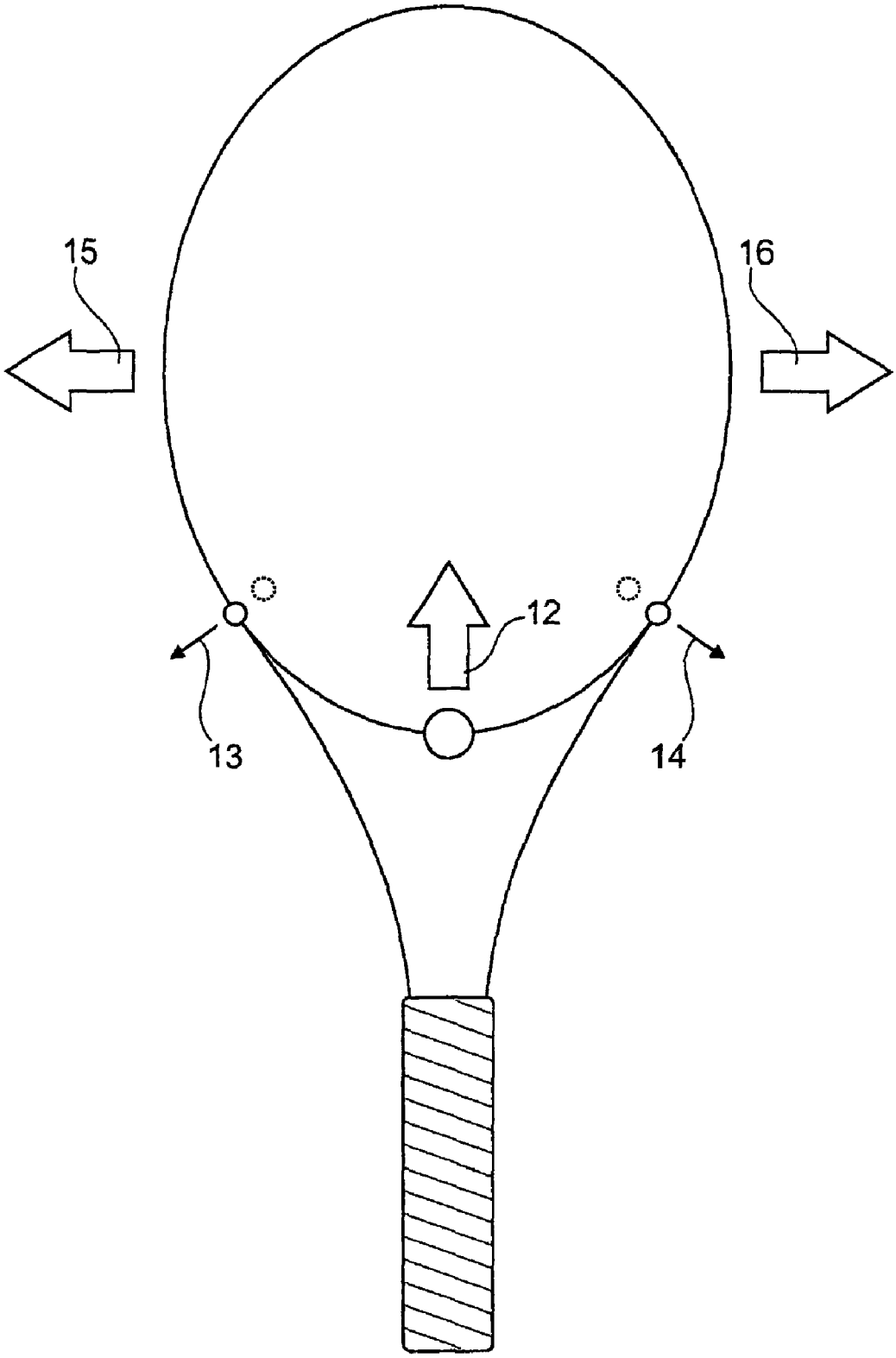
FIG. 5 shows a schematic diagram for explaining the function of the joint according to FIG. 3.

FIG. 5 shows a schematic diagram for illustrating the function of the joint according to FIG. 4. If a ball hits the stringing (not shown), the stringing is deflected due to the impulse transmission; consequently, a force is applied to the bridge 7 in the direction of the arrow 12. A conventional racket in which the bridge is essentially stiff would react with a relatively small deformation of the bridge. However, since the bridge 7 of the invention comprises said joint 8, the bridge 7 will yield to the force 12 and the joint axis will move in the direction of the arrow 12. As a necessary consequence, however, the two bearing points at the arms 5 and 6 move outwardly, namely in the direction of arrows 13 and 14. Thus, the entire head region 1 of the racket is spread, the frame parts at approximately three and nine o'clock are pressed apart from each other, i.e. outwardly, in the direction of arrows 15 and 16, and thus the transverse strings therebetween are additionally tensioned.

Consequently, a racket according to the embodiment shown in FIGS. 4 and 5 leads to a cushioning of the ball impulse on the longitudinal strings while at the same time the impulse on the transverse strings is increased.

Figure 6:
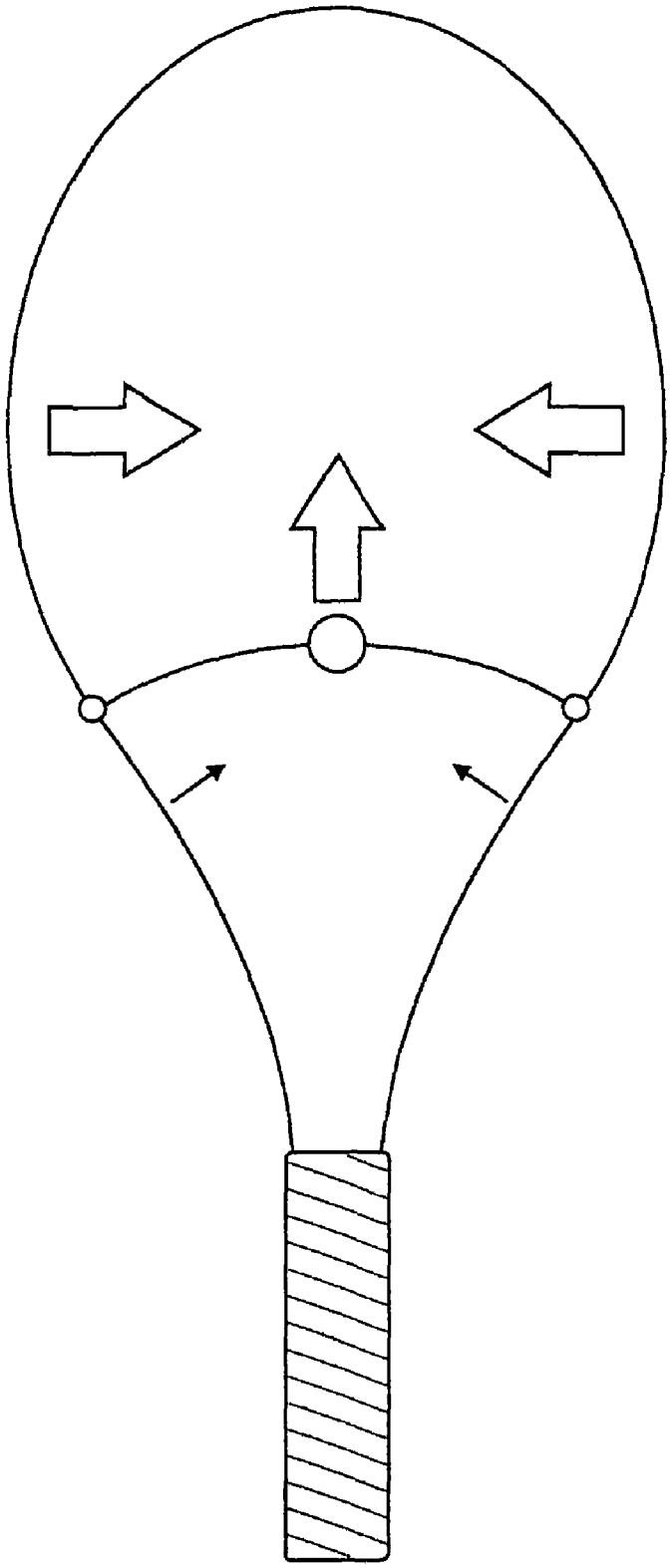
FIG. 6 shows a schematic diagram for explaining the function of the joint according to a variant of the embodiment of FIG. 3.

According to a second variant of this embodiment, the bride is, as shown in FIG. 6, concave relative to the handle portion, namely U-shaped, with the opening of the U being directed towards the handle portion. Analogously to the above explanations, it is clear that in this variant the impact of a ball has an essentially contrary effect. The deformation of the bridge 7 leads to a contraction of the head region 1 and thus a slackening of the transverse strings, as illustrated by the respective arrows.

A combination of this embodiment with the embodiments shown in FIG. 1 and/or FIG. 3 is also possible.

The present invention has an advantageous effect on the playing behavior of a racket according to the invention in that the deformation behavior of the racket can be adjusted in a well-aimed and controlled manner. For example, the embodiment of the racket shown in FIG. 1 is "softer" than a conventional racket in a direction perpendicular with respect to the longitudinal axis of the racket, while the elasticity of the racket along the longitudinal axis of the racket is essentially not influenced. This might be advantageous to the vibration spectrum of the racket and thus to its playing behavior. Also the embodiment of FIG. 4 allows a controlled influence on the vibration spectrum. As already explained in connection with FIGS. 5 and 6, in this racket the reactions of the longitudinal and transverse strings to the impulse of an arriving ball can be adjusted independently. For example, an impulse increase caused by an additional tension of the transverse strings due to the deformation of the bridge is possible (see FIG. 5).

The invention claimed is:

1. A racket for ball games comprising:

a head region for receiving a stringing; and a throat region comprising two arms and a bridge, wherein the bridge comprises at least one joint, the joint axis of which is arranged essentially perpendicularly with respect to a stringing plane formed by the stringing, and wherein the bridge comprises two legs which are mounted in a movable manner at the arms and connected with each other by the joint.

2. The racket according to claim 1, wherein the bridge is concave relative to the head region.

3. The racket according to claim 2, wherein the bridge is substantially V-shaped or U-shaped, with an opening of the V or U being directed towards the head region.

4. The racket according to claim 1, wherein the bridge is convex relative to the head region.

5. The racket according to claim 4, wherein the bridge is substantially V-shaped or U-shaped, with a point of the V or U being directed towards the head region.

6. The racket according to claim 1, wherein the bridge also forms a portion of the head region.

7. A racket for ball games, comprising:

a frame, including:

a head region for receiving a stringing, the stringing forming a stringing plane, and at least one joint connecting a first portion of the frame to a second portion of the frame, wherein the joint includes a joint axis arranged substantially perpendicularly with respect to the stringing plane, and articulation of the joint distorts at least a portion of the head region from a first shape to a second shape.

8. The racket according to claim 7, wherein the at least one joint is positioned along the head region.

9. The racket according to claim 7, wherein the first portion of the frame and the second portion of the frame form at least a portion of the head region.

10. The racket according to claim 7, wherein the at least one joint is arranged in the head region between two o'clock and four o'clock or between eight o'clock and ten o'clock or between eleven o'clock and one o'clock.

11. The racket according to claim 10, wherein the at least one joint is arranged at approximately twelve o'clock.

12. The racket according to claim 10, wherein the at least one joint includes at least two joints, a first joint arranged at approximately three o'clock and a second joint arranged at approximately nine o'clock.

13. The racket according to claim 10, wherein the at least one joint includes at least two joints, a first joint arranged at approximately four o'clock and a second joint arranged at approximately eight o'clock.

14. The racket according to claim 10, wherein the at least one joint includes at least two joints, a first joint arranged at approximately two o'clock and a second joint arranged at approximately ten o'clock.

15. The racket according to claim 10, wherein the at least one joint includes a hinge joint or ball joint.

16. The racket according claim 10, wherein the head region comprises joint forks and/or eyes which are connected with each other in a movable manner by insertable joint bolts.

17. The racket according to claim 10, wherein the at least one joint comprises at least one end stop for limiting articulation of the at least one joint.

18. The racket according to claim 17, wherein the at least one joint allows pivoting angles ranging between −15 to 15 degrees.

19. The racket according to claim 18, wherein the at least one joint allows pivoting angles ranging between −10 to 10 degrees.

20. The racket according to claim 19, wherein the at least one joint allows pivoting angles ranging between −5 to 5 degrees.

* * * * *